US008196670B2

(12) United States Patent
Jenner

(10) Patent No.: US 8,196,670 B2
(45) Date of Patent: Jun. 12, 2012

(54) DOWNHOLE DEVICE

(75) Inventor: Andrew Jenner, Vechta (DE)

(73) Assignee: Domain Licences Limited, Tortola (VG)

( * ) Notice: Subject to any disclaimer, the term of this patent is extended or adjusted under 35 U.S.C. 154(b) by 0 days.

(21) Appl. No.: 12/709,948

(22) Filed: Feb. 22, 2010

(65) Prior Publication Data

US 2011/0030973 A1 Feb. 10, 2011

(30) Foreign Application Priority Data

Aug. 10, 2009 (GB) ..... 0913979.1

(51) Int. Cl.
*E21B 23/00* (2006.01)

(52) U.S. Cl. ..... 166/382; 166/241.1; 166/241.6; 166/380

(58) Field of Classification Search ..... 166/382, 166/241.1, 380, 241.6, 65.1
See application file for complete search history.

(56) References Cited

U.S. PATENT DOCUMENTS

| | | | | |
|---|---|---|---|---|
| 2,515,149 | A * | 7/1950 | Willhoit | 166/241.6 |
| 2,789,870 | A | 4/1957 | Hanes | |
| 2,846,016 | A | 8/1958 | Hanes | |
| 5,641,018 | A | 6/1997 | King | |
| 2001/0037882 | A1 | 11/2001 | Linaker | |
| 2003/0000607 | A1 | 1/2003 | Jenner | |
| 2003/0019624 | A1 * | 1/2003 | Davis | 166/241.6 |
| 2003/0230411 | A1 | 12/2003 | Bennett | |
| 2008/0264629 | A1 | 10/2008 | Buytaert | |
| 2008/0283237 | A1 | 11/2008 | Buytaert et al. | |
| 2009/0008086 | A1 | 1/2009 | Ehlinger | |

FOREIGN PATENT DOCUMENTS

| | | | |
|---|---|---|---|
| DE | 1169387 | A1 | 5/1964 |
| DE | 102005040482 | A1 | 3/2007 |

OTHER PUBLICATIONS

Search Report under Section 17, Intellectual Property Office, International Application No. GB0913979.1, Date of Search, Mar. 1, 2010.

* cited by examiner

*Primary Examiner* — Jennifer H Gay
*Assistant Examiner* — Yong-Suk Ro
(74) *Attorney, Agent, or Firm* — Hamilton, Brook, Smith & Reynolds, P.C.

(57) ABSTRACT

A stop collar or like device is formed in one piece to have a portion for a tool to be attached. Movement of the tool allows the collar to be drawn tightly into engagement onto a pipe or other tubular member. A bow centraliser has alternate bows longitudinally offset to reduce initial insertion force. The centraliser may be formed to have end bands of the type used in the stop collar.

8 Claims, 18 Drawing Sheets

DOWNHOLE DEVICE

RELATED APPLICATION

This application claims priority under 35 U.S.C. §119 or 365 to Great Britain, Application No. 0913979.1, filed Aug. 10, 2009. The entire teachings of the above application are incorporated herein by reference.

TECHNICAL FIELD

The present invention relates to the field of downhole devices, and more specifically but not exclusively to the field of such devices usable in oil and/or gas extraction. Some embodiments concern stop collars or like devices. Some others relate to centralizers.

BACKGROUND

Stop collars are used in downhole environments, for instance in the oil and gas industry, to mount around a tubular member such as a length of pipe, drill string or tubing string to engage and grip the exterior of the tubular member. Stop collars provide a stop shoulder on the tubular member to restrict axial travel along the tubular member of any further associated product—for example a centralizer—that is assembled onto the exterior of the tubular member.

As known to those skilled in the art, a stop collar, sometimes referred to as a stop ring or similar terminology, is commonly used to restrain the axial movement of products such as but not limited to centralizers that are assembled onto the tubular members (sometimes referred to as "tubulars") of a well casing.

Centralizers are devices that engage over a tubular member, as above, and that have an external envelope intended to contact the bore to maintain that tubular member generally out of contact within—and ideally central within—the bore.

Stop collar design must cope with free fitment onto tubulars having poorly toleranced outer diameters. The reader is directed to American Petroleum Institute API 5CT which states that the tubular outer diameter tolerance is "nominal diameter+1%". It may be seen that a most common tubular size of "nine and five-eights" (9⅝ inch, 24.47 cm) could be 9.625 inch to 9.721 inch (24.47 cm to 26.92 cm) outer diameter. Any design applied must take up this tolerance as prerequisite to applying sufficient load to give the desired axial load restraint.

The many current stop collars or like devices used to resist axial loading rely on various methods of partially penetrating into the surface of the tubulars under action of locally applied axial loads. Two of the most common methods employed are toughened steel screws radially dispersed around the circumference of the stop collar, and hardened steel inserts wedged between the stop collar and the tubular surface.

Penetration of the surface of the tubulars creates significant marking which can lead to stress concentration and cause stress corrosion cracking when the tubular is placed in its operating environment. Where tubulars consist of an alloy containing for example chrome, commonly 13% or more, galvanic corrosion between the toughened steel screws and the chrome alloy surface exacerbates the tubular life failure rate.

Current arrangements are unable to resist axial loads of a magnitude similar to the load bearing capabilities of the associated components they are supposed to hold in position i.e. centralizers in either tension or compression. Increasing the number of radially disposed screws or wedges dramatically increases the stress corrosion potential. Users seek to balance between desired axial holding ability and the said increase in stress corrosion.

It is a further problem that assembly of the stop collar onto the tubular, in the field, is frequently delegated to unskilled labour. It is common practice to assemble, for example screws, with little regard to correct torques applied or to whether the threads are suitably lubricated. This latter point has an inbuilt hazard in that screws are frequently split, through incorrect torque applied, which will not be apparent to the personnel carrying out the assembly. The result possibly leads to even lesser axial holding ability as the tubular is traversed into its operating position. By default the screws employed must be small enough to fit with suitable clearance within the annulus formed between the tubular on which they are affixed and the wellbore or internal diameter of previously installed larger tubular, said screws commonly being 1.27 cm×1.27 cm (½"×½") long socket set screws which have only a 0.635 cm (¼") across flats hexagonal drive form. Hexagonal wrenches are small, have a very short life and the tendency is not to change for new hexagonal drives before rotational failure of the hexagonal drive corners, with resultant insufficient torque input to achieve desired axial holding forces.

The protrusion of screws or wedge devices beyond the outer diameter of the stop collar main body considerably restricts the use of traditional stop collars in a narrow annulus configuration existing between the tubular to which the stop collars are affixed and the wellbore or internal diameter of a previously installed larger tubular.

The aforementioned design practices of multiple part stop collar constructions may result in lost parts of the stop collar, or associated components, falling into the wellbore. This is considered as catastrophic in the industry.

Problems also occur with centralizers where the bore has an upper part of a generally smaller cross section than a lower part where the centralizer is needed to act. Clearly the centralizer must pass through the upper part without breakage, and without requiring too great an insertion force. The two constraints may of course be interrelated.

One such scenario is with so-called "under-reamed" bores. This occurs for example where wellbores are 'opened out' in a region lower than a previously installed tubular.

In one example, a drill bit is passed through the 21.68 cm (8.535") internal diameter. of a previously installed 24.45 cm (9⅝") tubular and then the bit is rotated out of concentric to create a 24.13 cm (9.5") hole. So, a centralizer is required to fit the nominal size of 24.13 cm (9.5") diameter so as to centralize a tubular in that bore, but also is required to pass through 21.58 cm (8.535") diameter of the upper tubular.

SUMMARY

In a first aspect there is provided a one-piece device for engagement over and onto a downhole tubular comprising a generally cylindrical band having at least one arcuate portion with opposing end regions, the end regions being coupled together by a connecting portion having a pair of arm portions extending on respective sides of a body portion, distal ends of the arm portions extending into the end regions, the body portion having a formation for engagement therein of a tool whereby rotation of the body portion by a tool varies the size of the device, the device further comprising engagement means to secure the arm portions with respect to an adjacent end region so that the device can be locked.

The device may have a plurality of arcuate portions each having respective end regions, and a corresponding plurality of connecting portions.

The connecting portions may be generally S-shaped.

The arcuate portions may have prolongations to form guides for constraining sideways movement of the arm portions.

The guides may have teeth to interact with counterpart teeth on the arm portions to form the engagement means.

The device may be substantially circular with an axis, the or each arcuate portion have a first axis-parallel width and the arm portions have a second axis-parallel width that is less than the first width.

The device may be of a micro-alloy steel. An example that may be used is boron steel.

In a second aspect, there is provided a stop collar or like device which is adapted to mount around a tubular member such as a length of pipe, drill string or tubing string to grip the exterior of the tubular member and restrict axial travel of any further associated product that is assembled onto the exterior of the tubular member along the member, the device being characterised in that the construction of the stop collar and a means of activating radial gripping of a tubular member is from a single piece of material.

In a third aspect there is provided a method of securing a one-piece stop collar to a tubular comprising sliding the stop collar over the tubular to a desired location, and rotating a portion of the stop collar to draw the collar tighter onto the tubular.

Prior art examples, where sufficient annular width allows, have attempted to draw the open ends of a stop collar band or ring together for example with bolt and nut designs. The desire to change developed circumferential length requires that slippage takes place between all of the internal diameter of the stop collar and the surface of the tubular to which it is being affixed yet achieve high radial loads. It is given that the two desires are contradictory.

In a fourth aspect, a centralizer has first and second opposing end collars that are axially separated by plural spring bows, the spring bows forming a generally convex curve, with first bows extending from the first end collar substantially axis parallel for a first distance before extending via the curve into the second end collar, and second bows extending curvedly from the first end collar and into a substantially axis parallel portion at the second end collar, whereby the centralizer is formed of a single piece of material.

The material may be a micro-alloy steel. The micro-alloy steel may be boron steel.

One or both collars of the centralizer may be in accordance with the first aspect.

In a further aspect there is provided a device for disposition on a tubular member, the device having a band or collar, and having plural resilient axial protrusions for distributing point loading.

BRIEF DESCRIPTION OF THE DRAWINGS

Example embodiments will now be described with reference to the attached drawings to enable the reader to better understand the invention. In the drawings.

DETAILED DESCRIPTION OF THE INVENTION

Figure 1:
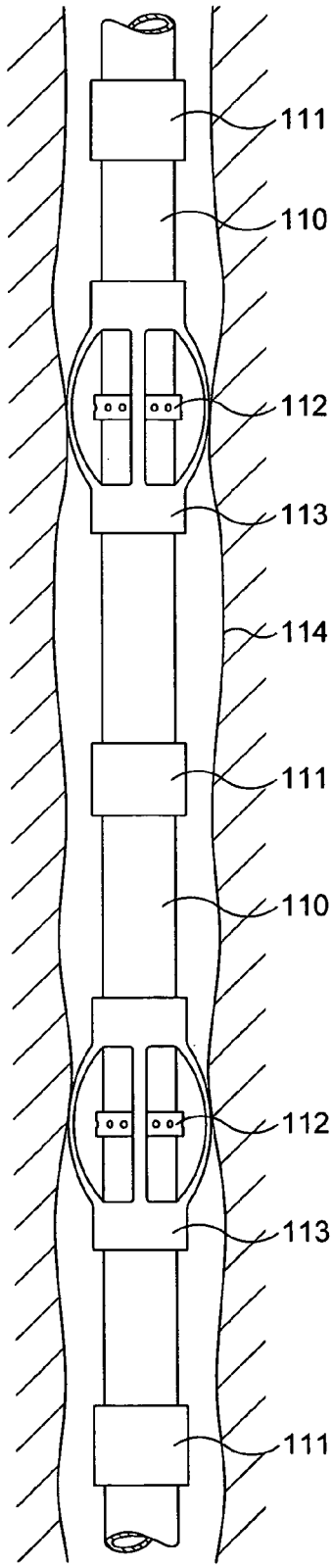
FIG. 1 shows schematically a typical arrangement of a tubular centralized within a borehole.

Referring to FIG. 1, a tubular is formed from a plurality of lengths 110 connected together by couplings 111. As is well known, a centralizer 113 is supported on each length 110 by way of a respective stop collar 112. Each centralizer 113 is arranged to support the tubular, formed of the lengths 10, within the borehole 114 such that the tubular is substantially centrally arranged.

Figure 2:
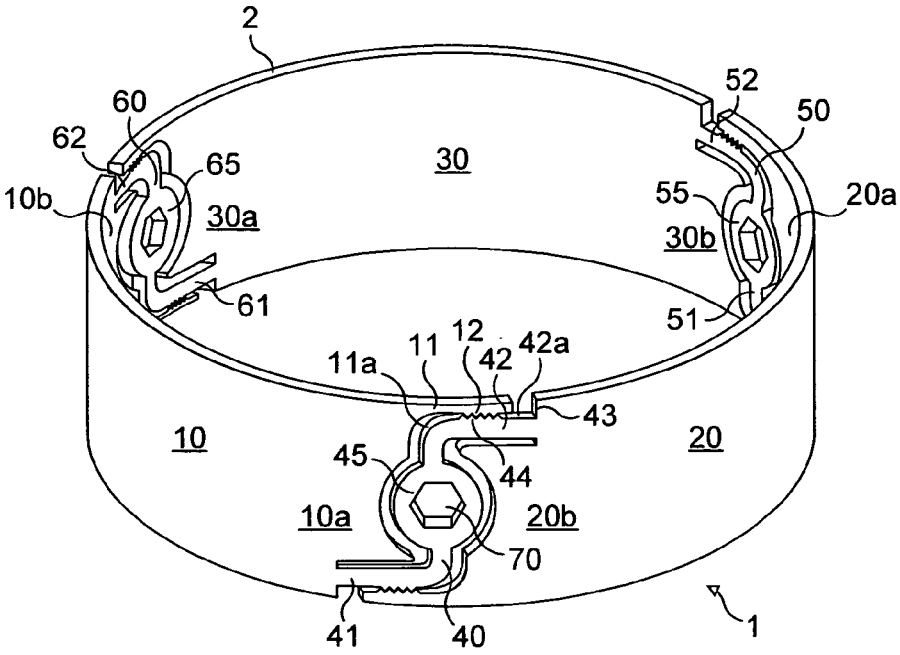
FIG. 2 is a perspective view of a stop collar of a first embodiment.

Referring to FIG. 2, an embodiment of a stop collar 1 is a broad generally cylindrical band formed of a single piece of material. The collar 1 has three arcuate portions 10, 20, 30 which have respective opposing end regions 10*a*, 10*b*; 20*a*, 20*b*; 30*a*, 30*b*. The end regions 10*a*, 10*b*; 20*a*, 20*b*; 30*a*, 30*b* are coupled together by respective connecting portions 40, 50 60. Each connecting portion 40, 50, 60 has a respective pair of narrow arm portions 41,42; 51,52; 61,62 extending on respective sides of a generally circular body portion 45; 55; 65. The connecting portions 40, 50, 60 with their arm portions 41,42; 51,52; 61,62 describe a generally "S" shape in the shown configuration, and the end regions 10*a*, 10*b*; 20*a*, 20*b*; 30*a*, 30*b* generally conform to the external form of the connecting portions 40, 50, 60.

Other shapes are possible, of course, for example "Z" shapes.

The arm portion 42 extends from a downwardly (as shown) inset location 43 of the end region 20*a* of the second arcuate portion 20, and extends—in this configuration—parallel to the upper circumference 2 of the collar 1. The end region 11*b* of the first arcuate portion 10 extends into a prolongation 11 forming a circumferential finger 11. The finger 11 serves at least partly to constrain the adjacent arm portion 42 to prevent sideways movement and consequent distortion of the collar 1.

Engagement means is provided to allow the collar 1 to be locked. In this embodiment the finger 11 has a lower (as shown) surface 11*a* abutting an upper (as shown) surface 42*a* of the arm portion 42. The finger 11 has toothed projections 12 on the lower surface 11*a* and the arm portion 42 has toothed projections 44 on the upper surface 42*a* to form the engagement means by securing the finger 11 to the arm portion 42. A like arrangement is provided at each arm portion 41, 42; 51,52; 61,62.

The circular body portions 45, 55, 65 have a formation for a tool. In this embodiment, the formation is a hex hole 70 dimensioned to be engaged by a hex key.

In use, the stop collar 1 is fitted and secured to a tubular by sliding the stop collar 1 over the tubular to a desired location, and rotating the body portions 45,55,65 one-by-one to draw the collar into tight engagement onto the tubular. The engagement state is maintained by the interlocking of the teeth of the toothed projections in a sort of ratchet fashion.

In summary, there is provided a circular band with radially-disposed cut forms each capable of being distorted or moved to draw adjoining areas closer together to change in total the circumferential developed-length of the stop collar in sequential minor increments to accommodate take up of the tubular diametral tolerance. Following this additional intentional distortion or movement gives rise to a radially inwards loading the sum of which supplies sufficient contact force between the inner diameter of the stop collar and the tubular to which it is affixed, to maintain it secured. The number of cut forms is not critical to the invention. In different embodiments different numbers than three may be provided commensurate with the tubular base diameter, the degree of tubular manufacturing tolerance to be taken up and the level of required axial holding ability of the final assembly.

In addition to addressing the problems of the prior art designs of stop collar as discussed above, embodiments provide a capability of accommodating for variations in diameter which exist on the tubular member due to manufacturing tolerances of tubulars. The segmental cut form design of the present invention may locally distort at each segment to proportionally reduce or eliminate contradictory radial and circumferential loads.

Distortion or movement together of segmental forms may be activated for example but not limited to substantially enlarged hexagonal wrenches for example 12 mm across flats as opposed to the prior art forms of common set screws with 6 mm across flats hexagonal drive apertures. Failure of the wrenches other than for reasonable wear is improbable.

In an embodiment the material chosen for the stop collar is heat-treatable to improve, for example, shear and tensile section strength properties. Such heat-treated strength may be of the order 90 tons per square in.

Segmental cut forms may be varied at will to suit design, manufacture, field assembly or performance demands.

The product may be manufactured to an undersize internal diameter to the tubular diameter for which it is intended to fit. Then the radially-disposed cut forms may be segmentally opened in reverse direction to expand the stop collar for easy assembly onto the tubular Internal diameter of the stop collar may be coated, deformed or machined to give for example low stress bearing point(s) to create a desirable friction increase between the modified stop collar internal diameter and surface of the tubular member to which it is affixed.

Where galvanic or stress corrosion conditions are to be avoided, the internal diameter of, say, a steel stop collar or ring main body may be coated with a suitable interface material to negate these problems. Example coatings may be, but not limited to, zinc or aluminium.

Unlike prior art designs, that of the embodiment enables the stop collar to closely hug the external diameter of the tubular to which it is affixed and:— have a flush external diameter thereby removing external protrusions which may interfere with free passage through the wellbore, facilitate use in narrow annulus configuration between the tubular member and the wellbore or previously installed larger tubular member plus, minimise encroachment of fluid flow cross sectional area of the annulus so formed.

Figure 3:
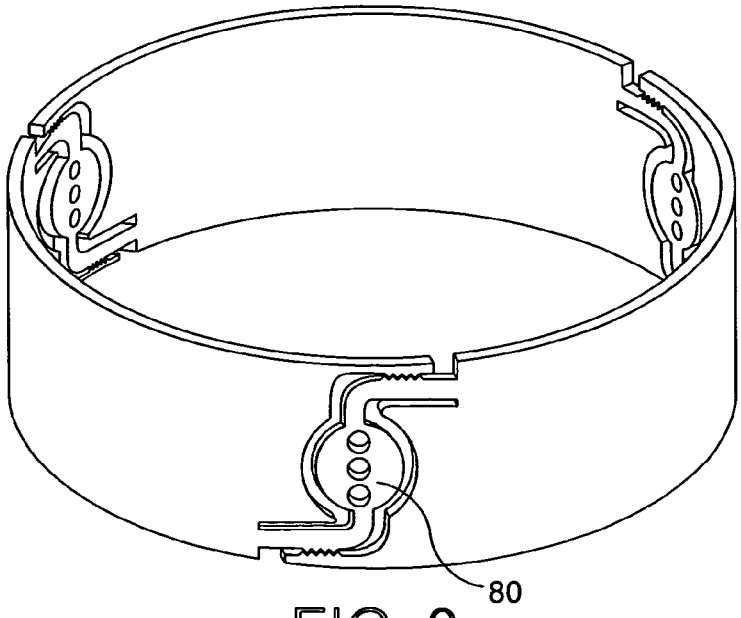
FIG. 3 is a perspective view of a stop collar of a second embodiment.

FIG. 3 shows a second embodiment in which the hex hole is supplanted by a different formation—here three smaller holes 80, aligned in a row. Other formations will be readily conceived by the skilled person.

Although the technique of the invention is shown in use as a stop collar, it is also applicable to other components used in similar context.

Figure 4:
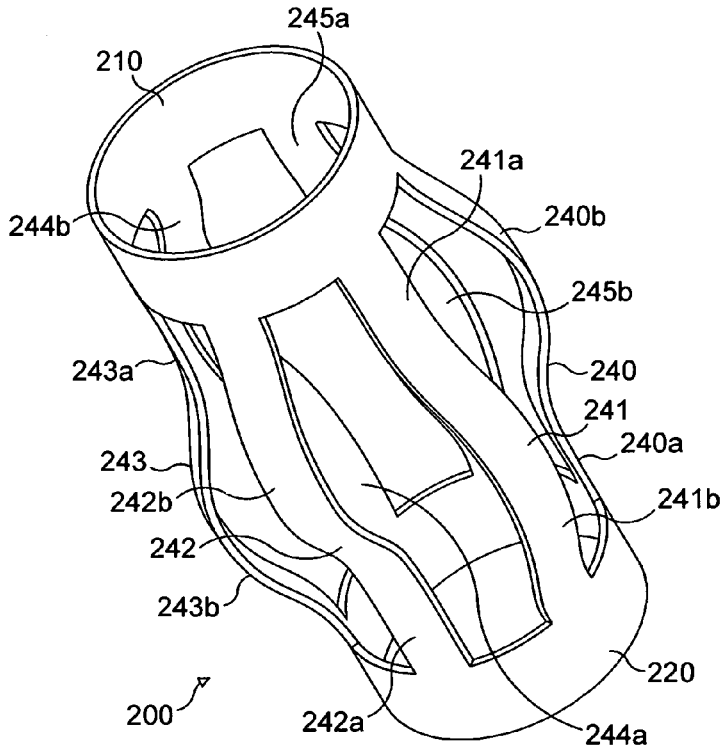
FIG. 4 is a perspective view of a first embodiment of a centralizer.

Referring to FIG. 4, a one-piece centralizer 200 has first and second opposing end collars 210,220 that are axially separated by plural spring bows 240-245. Each spring bow forming a generally convex curve. First bows 241,243,254 extending from the first end collar 210 with a respective portion 241*a*, 243*a*, 245*a* substantially axis parallel for a first distance before extending into a continuously curved portion 241*b*, 243*b*, 245*b* to the second end collar 220. Second bows 240,242,244 extend through respective curved portions 240*b*, 242*b*, 244*b* from the first end collar 210 and into a substantially axis parallel portion 240*a*, 242*a*, 244*a* at the second end collar 220. In this embodiment, the end collars are plain, and the centralizer be formed for cooperation with a stop collar.

Figure 7:
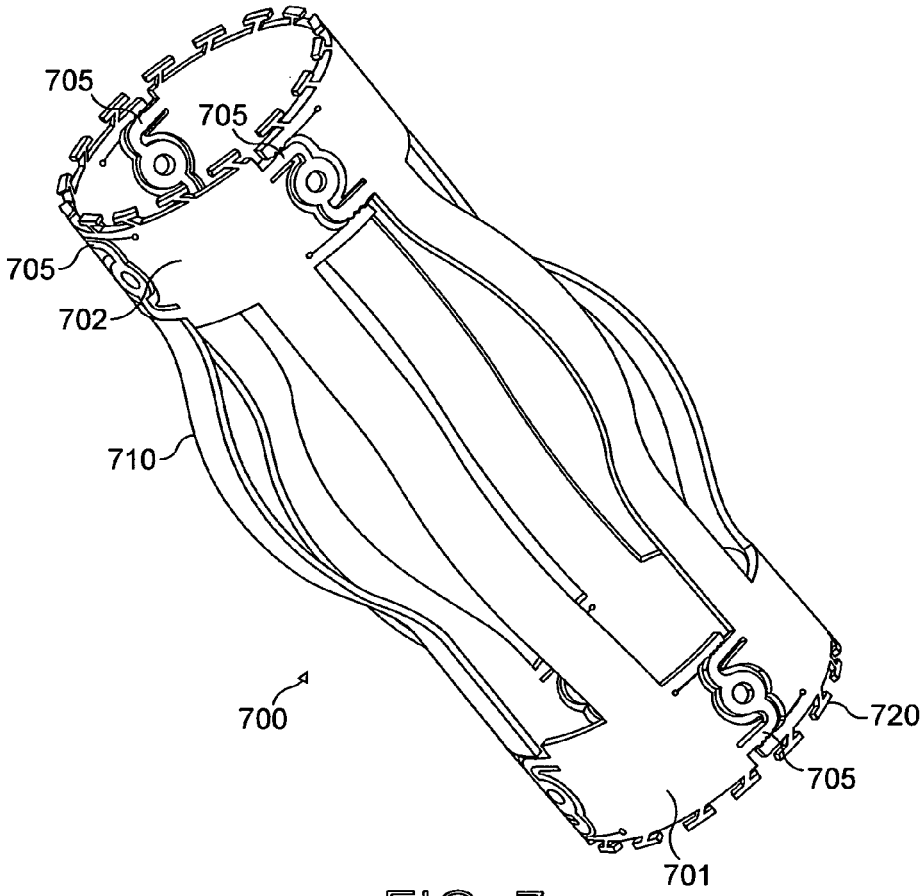
FIG. 7 shows a second embodiment of a centralizer.
Figure 8:
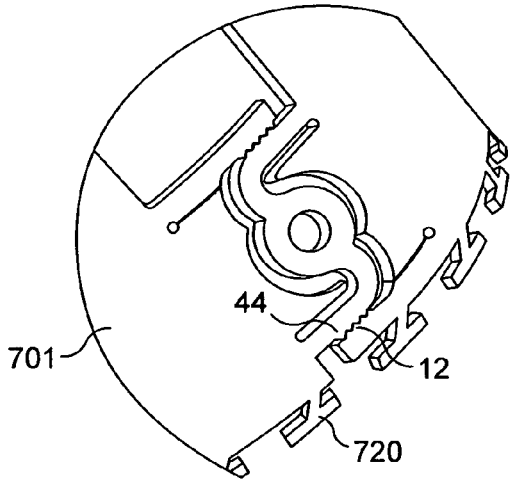
FIG. 8 shows a cut-away view of a part of the centralizer of FIG. 7.

However, in other embodiments—see for example FIGS. 7 and 8, the end collars are each end collar is formed similarly to the collar of FIG. 2.

In the illustrated embodiment there are 6 bows separated into two sets of three, with—in a circumferential direction—a first bow-type followed by a second bow-type followed by a first bow-type. The effect is to reduce very substantially (around 45%) the initial insertion force into a diameter that is smaller than the free outside diameter over the bows.

Figure 5:
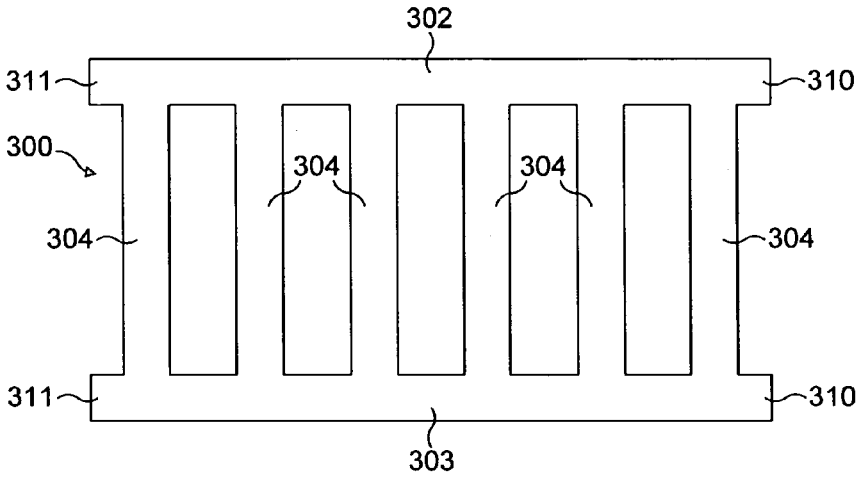
FIG. 5 shows an exemplary blank that may be used in forming the centralizer of FIG. 4.

The centralizer of the described embodiment has bows of equal length, and this means it can be made from a single blank, an example of which is shown in FIG. 5.

Referring to FIG. 5, a blank 300, is formed from a single sheet of boron steel. The blank has two transverse web portions 302, 303 spaced apart by six spaced longitudinal web portions 304 which extend substantially parallel to one another and perpendicular to the webs 302,303. The first and second transverse web portions 302, 303 are generally rectangular in shape, are mutually parallel. The six longitudinal web portions 304 extend between the transverse web portions 302,303 to define therebetween five apertures 309 of equal size. The outer longitudinal web portions 304 are inset from the ends of the transverse web portions by around half the width of the apertures 309 to leave free end portions 310,311 of the transverse web portions. The free end portions are, in a first embodiment of a centralizer, overlappingly secured together so that each first end portion 310 overlaps its corresponding second end portion 311 whereby the centralizer forms a generally cylindrical device. In other embodiments, the length of the free end portions is greater, and in these embodiments the free end portions are subsequently formed into connecting devices.

The web portions 302,303 form the collars 210, 220 of FIG. 4. The longitudinal web portions 304 form the bows 240-245 of FIG. 4. Bending operations are performed on the bows to achieve the configuration of FIG. 4.

It will, of course, be understood that this is a purely exemplary blank and is used here illustratively. Boron steel is only one example of the materials that may be used, which include mild steel and many other different materials. One class of steel—which includes boron steel—is the class of micro-alloy steels. This class has been shown to be generally useful.

The blank is formed by cutting or punching from the sheet. A preferred technique is a high accuracy computer-controllable cutting method such as laser-cutting or water jet-cutting. Such a technique can allow great flexibility, for instance enabling 'specials' to be produced without a need for expensive dedicated tooling.

The blank is then cold-formed into a generally cylindrical shape. This may be accomplished by rolling or by other techniques known in themselves in the art.

The relatively ductile nature of the boron steel material forming the blank allows for the blank to remain in its cylindrical state after the forming has taken place.

With a known one-piece centralizer a major benefit is that due to the efficiency of leaf spring bows blending homogenously into the end bands at either end, the centralizer could be slide fit into the nominal size wellbore diameter as they were onto the load/deflection performance curve immediately upon the onset of load. By contrast, the traditional spring bow products needed to be greatly oversize to achieve performance and so imparted a high initial insertion force.

Figure 6:
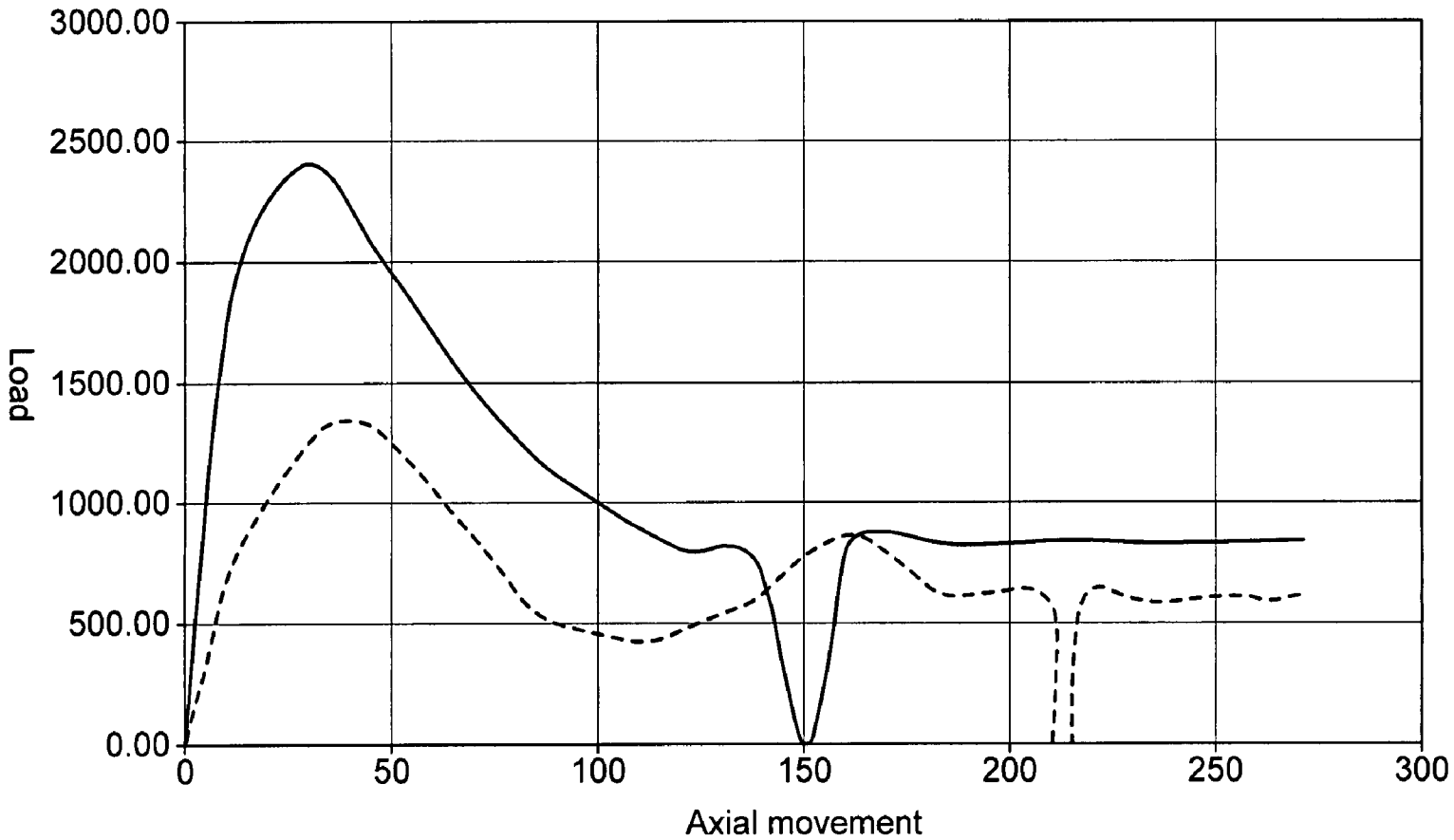
FIG. 6 shows a graph of insertion force for a centralizer embodying the invention by comparison with a prior art centralizer.

Referring to FIG. 6, the full (undashed) line shows a centralizer to exactly the same bow chordal width and bow height and without longitudinal offset of every other bow.

On this type the initial insertion force is quite savage as all 6 bows are being urged together towards the restriction and the centralizer is trying to change the developed length so as to conform to the restriction. Typically there is a loss of bow height by as much as 1.5 cm (0.6 in) on diameter as permanent set or yield occurs where the bow meets the end band. This loss means the centralizer outside diameter can reduce to 23.5 cm (9.25") to locate in a 25.1 cm (9.875") well bore. This itself is an improvement over previous types of centralizer.

The dashed curve shows the performance of a 6-bow centralizer embodying the invention where we still have the contradiction of pushing towards the resistance which is against bows trying to change their developed length. With only 3 bows entering initially the initial insertion force is only 60%, (there is still some reshaping of the bow profile until it conforms to the restriction diameter). However it remains within the specified yield and on test only lost about 0.4 mm (0.017") on bow height—as well as considerably lower insertion force and some 25% reduction on re-start of axial travel within the restriction we now have a near 25.1 cm (9.875") outside diameter centralizer for the 25.1 cm (9⅞") well bore.

This is more clearly described later herein with respect to FIG. 21.

It may also be noted on the dashed curve that the 1st set of 3 bows entering takes approximately 5956N (1339 lbf) whereas the 2nd set of 3 only takes approximately 3816 N (858 lbf) to enter. This is because as the 1st set is being squeezed down in diameter they are being resisted by the as-yet to enter 2nd set which is, in effect, being demanded to start changing length before entering the restriction.

In FIG. 7, a second centralizer 700 has a pair of end collars 701, 702, each with formations 705 similar to those described with reference to FIG. 2. The bows 710 of centralizer 700 are similar to those described with reference to FIG. 4. The end collars 701, 702 each have flexible protrusions 720 at their outer ends. The form of these protrusions may be selected as desired.

In this example—shown more clearly in FIG. 8—the flexible protrusions 720 axially from each end collar and have a 7' section. Each of these is apt to flex to distribute point loading forces as adjacent 7' springs come in contact when the centralizer abuts against a stopping device placed externally to the centralizer 700 on a tubular.

Figure 9:
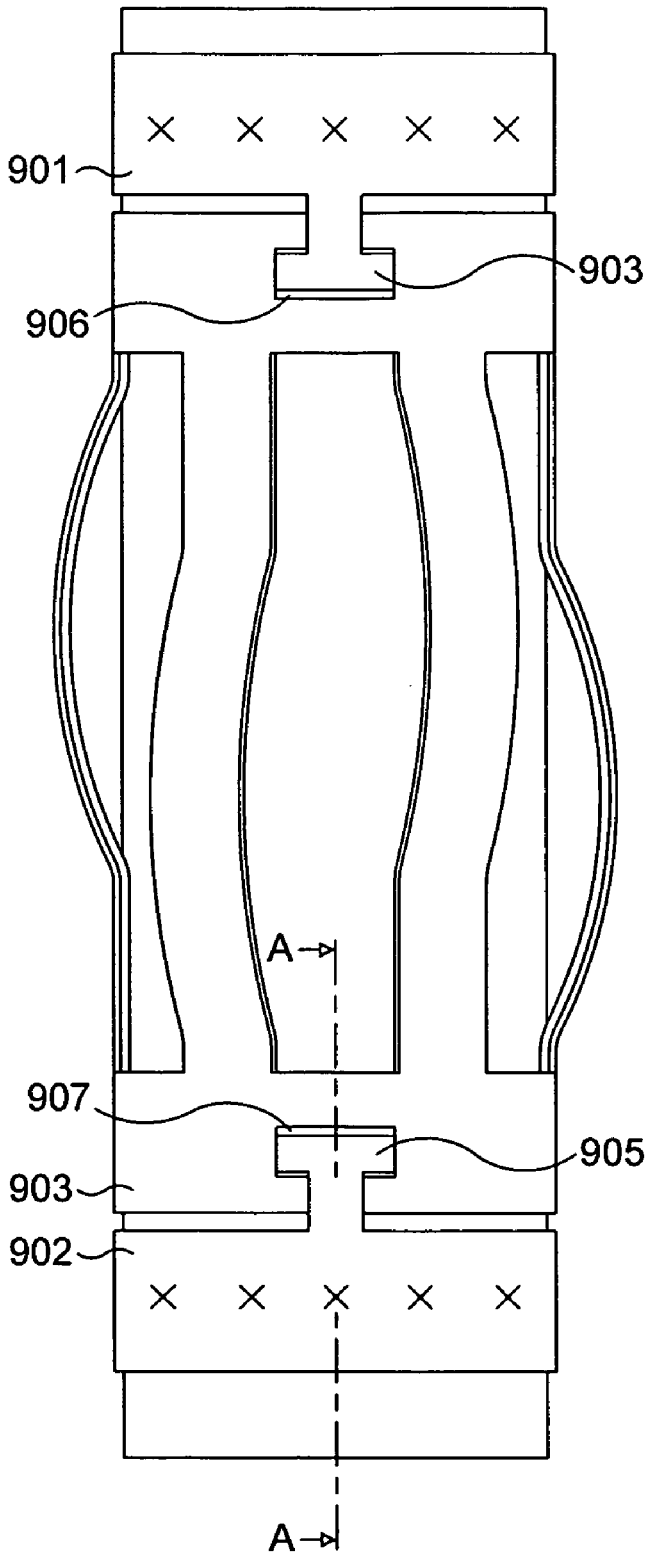
FIGS. 9 to 20 show further embodiments of centralizers.

In FIG. 9 stop collars 901, 902 are fitted on both sides of the bow centralizer 903. Each of the stop collars has a circumferentially distributed plurality of T-shaped projections 904, 905 that extend into corresponding female T-shaped apertures 906, 907 of the centralizer 903. The female apertures 906, 907 have sufficient clearance to allow for increase in developed length of the centralizer when the bows are reduced in outer diameter.

The fixing devices for the stop collars 901, 902 may be conventional—e.g. set-screws as is commonly provided in existing products—or may alternatively use the ratchet device described above with respect to FIG. 2.

Figure 10:
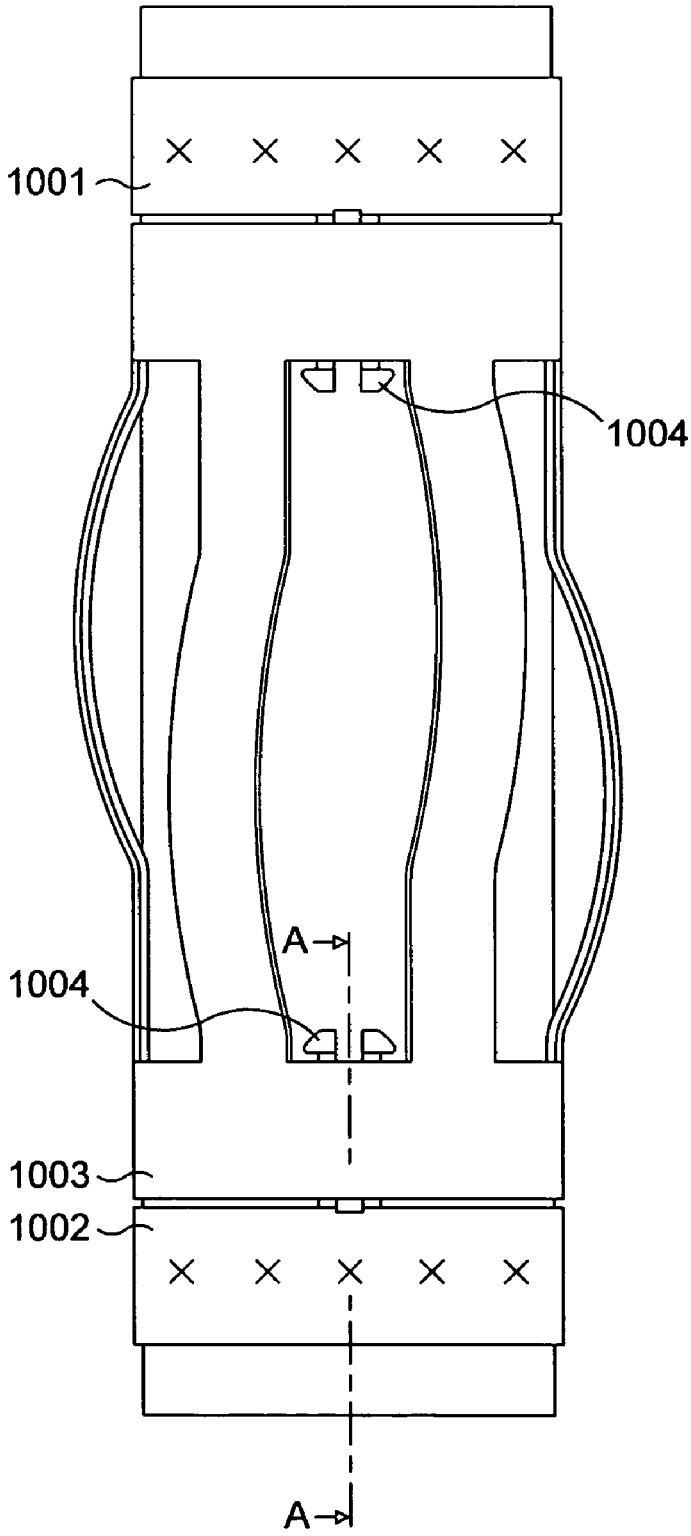

Turning now to FIG. 10, in this figure there will be seen two stop collars 1001, 1002 and a centralizer 1003. The stop collars each have half-thickness bayonet fastenings 1004 projecting parallel with the axis of the centralizer and stop collars. The bayonet fastenings have outer faces machined to half thickness and the end bands of the centralizer 1003 are machines to half thickness on their inner face to allow for engagement by the bayonets.

Figure 11:
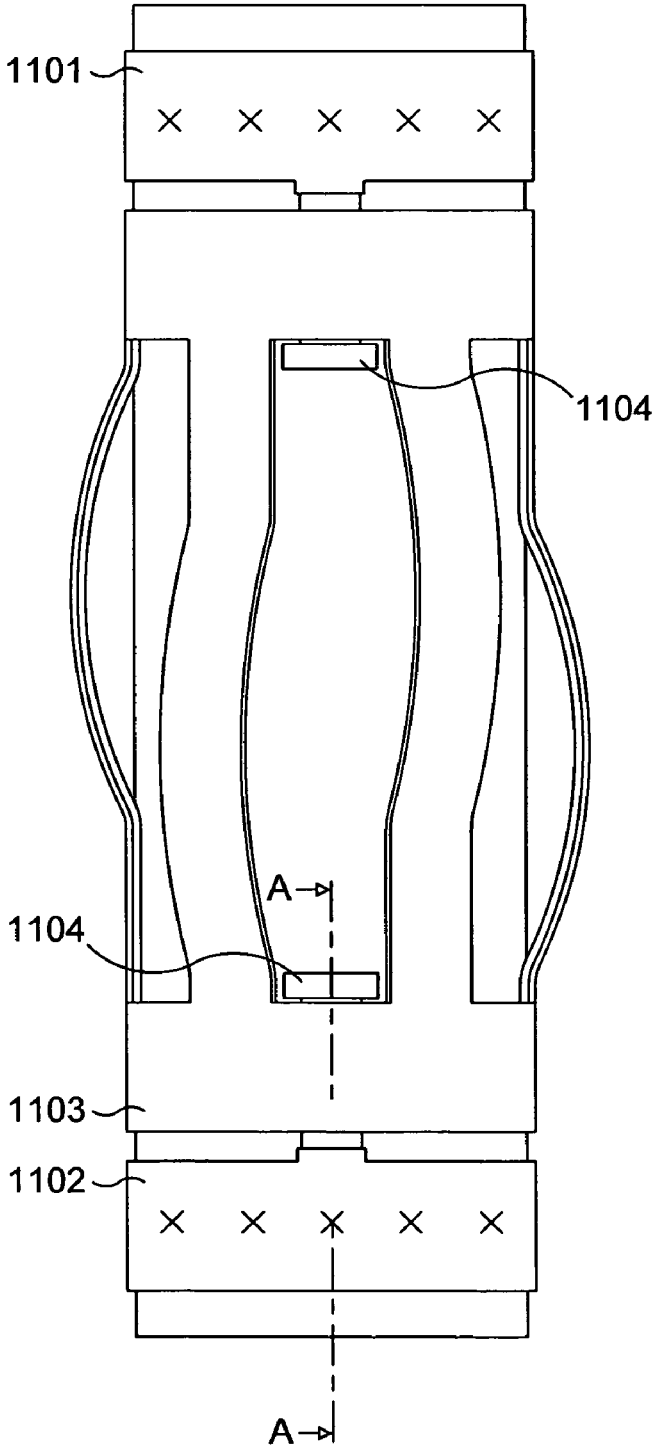

Referring to FIG. 11, in this embodiment there are two stop collars 1101, 1102 with generally similar bayonet fastenings 1104 to those of FIG. 10, but in this case the centralizer 1103 is pre-assembled with the stop collars 1101, 1102 so as to be slid on to a tubular in a single assembly.

Figure 12:
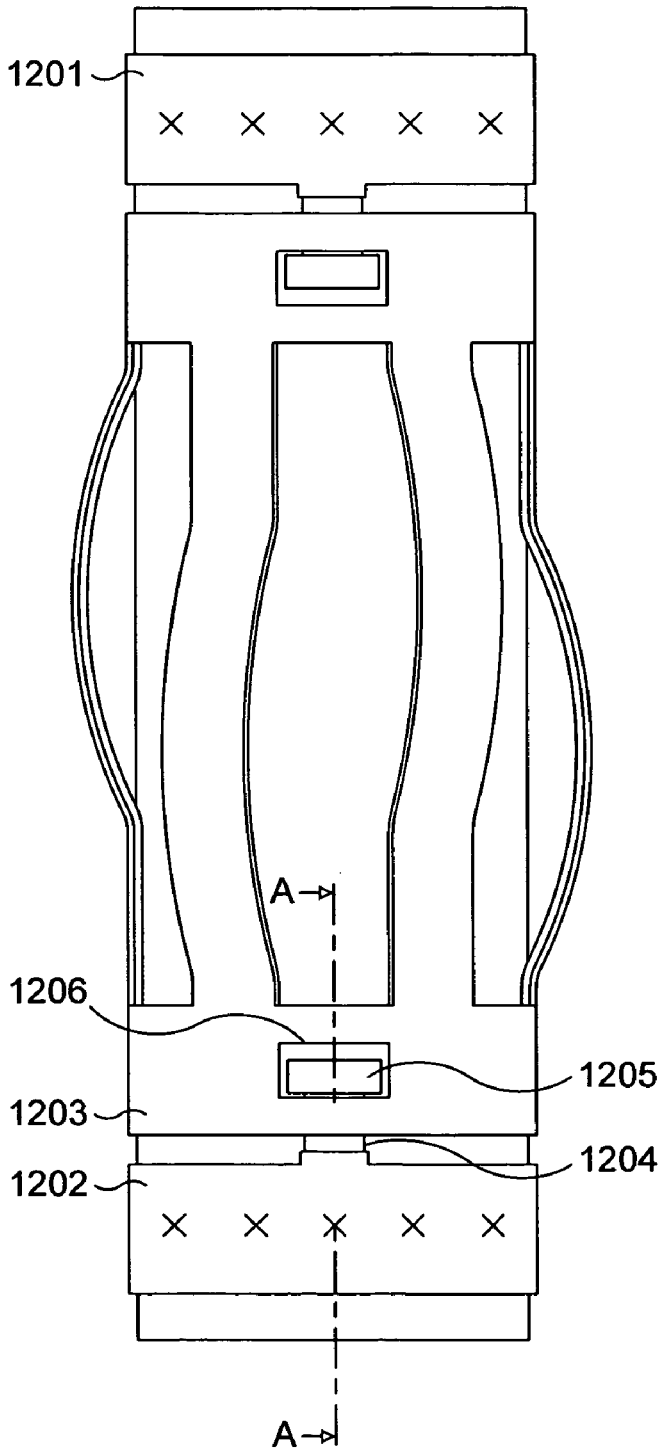

Turning to FIG. 12 two stop collars, 1201, 1202 engage with a bow centralizer 1203. The stop collars have extending bayonet fastenings 1204 but the fastenings are engaged with heads 1205 into apertures 1206. The apertures 1206 are windows that are sufficiently oversized with respect to the head 1205 of the bayonet fastening 1204 to allow for the required extension of the bows when compressed sideways.

Figure 13:
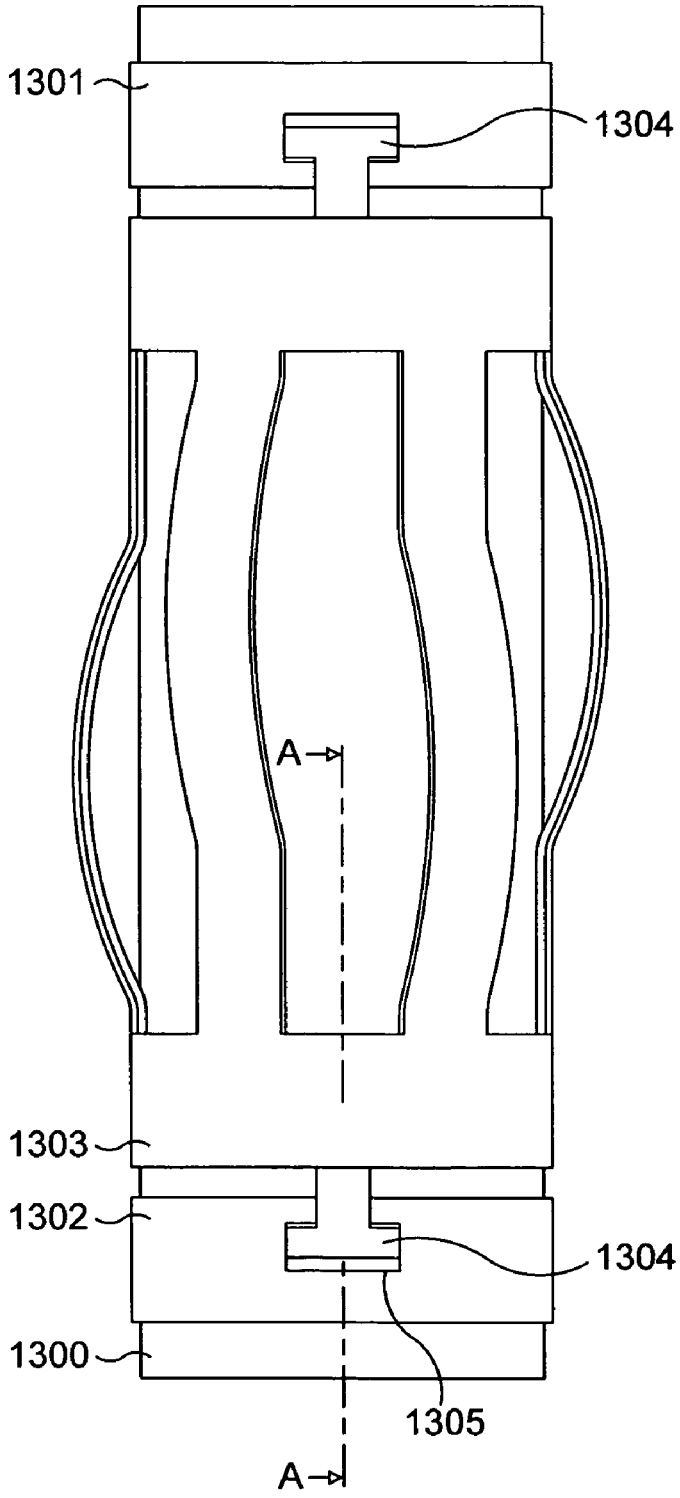

Turning to FIG. 13 there is shown an arrangement with two stop collars 1301, 1302 and a bow centralizer 1303 on a tubular 1300. The centralizer 1303 has axially outwardly projecting T-shaped portions 1304 that extend to and engage in suitably-formed cut-out windows 1305 in the stop rings 1301, 1302.

Figure 14:
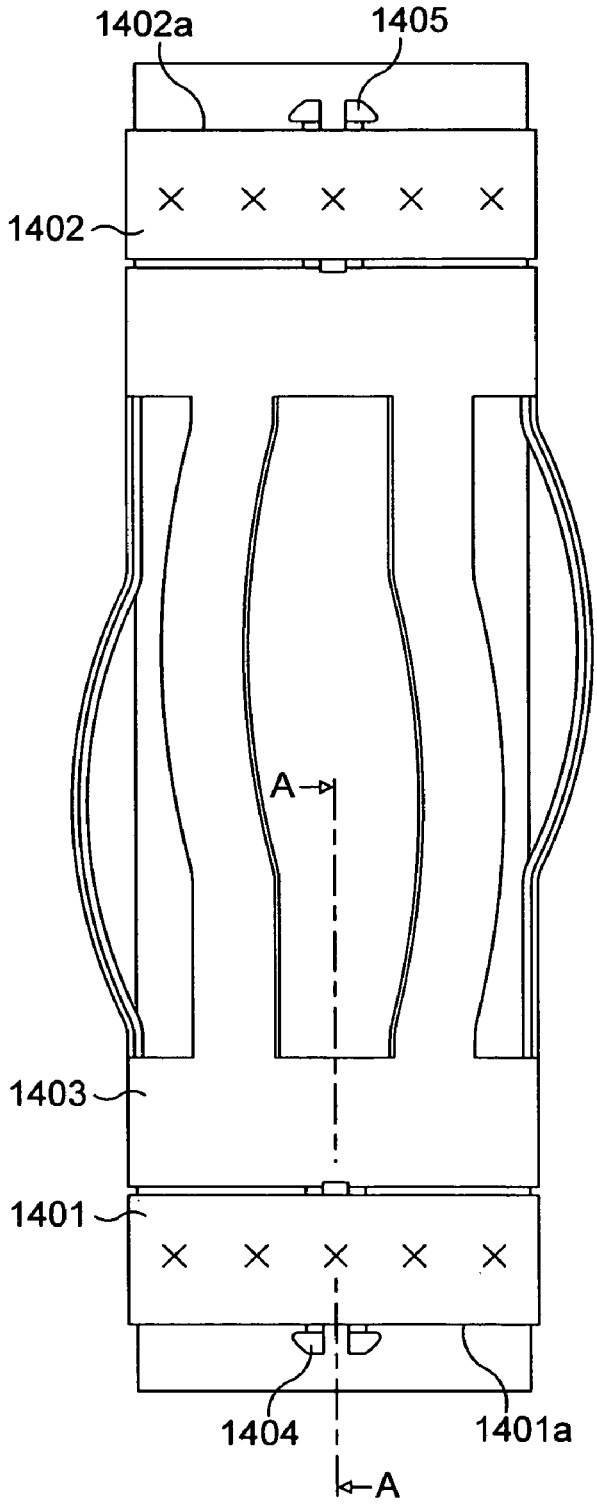

Turning to FIG. 14, in this embodiment there are two stop rings 1401, 1402 and a centralizer 1403 that has axial projections of the bayonet type 1404, 1405 that engage with the outer peripheral circumference 1401*a*, 1402*a* of the stop collars 1401, 1402.

Figure 15:
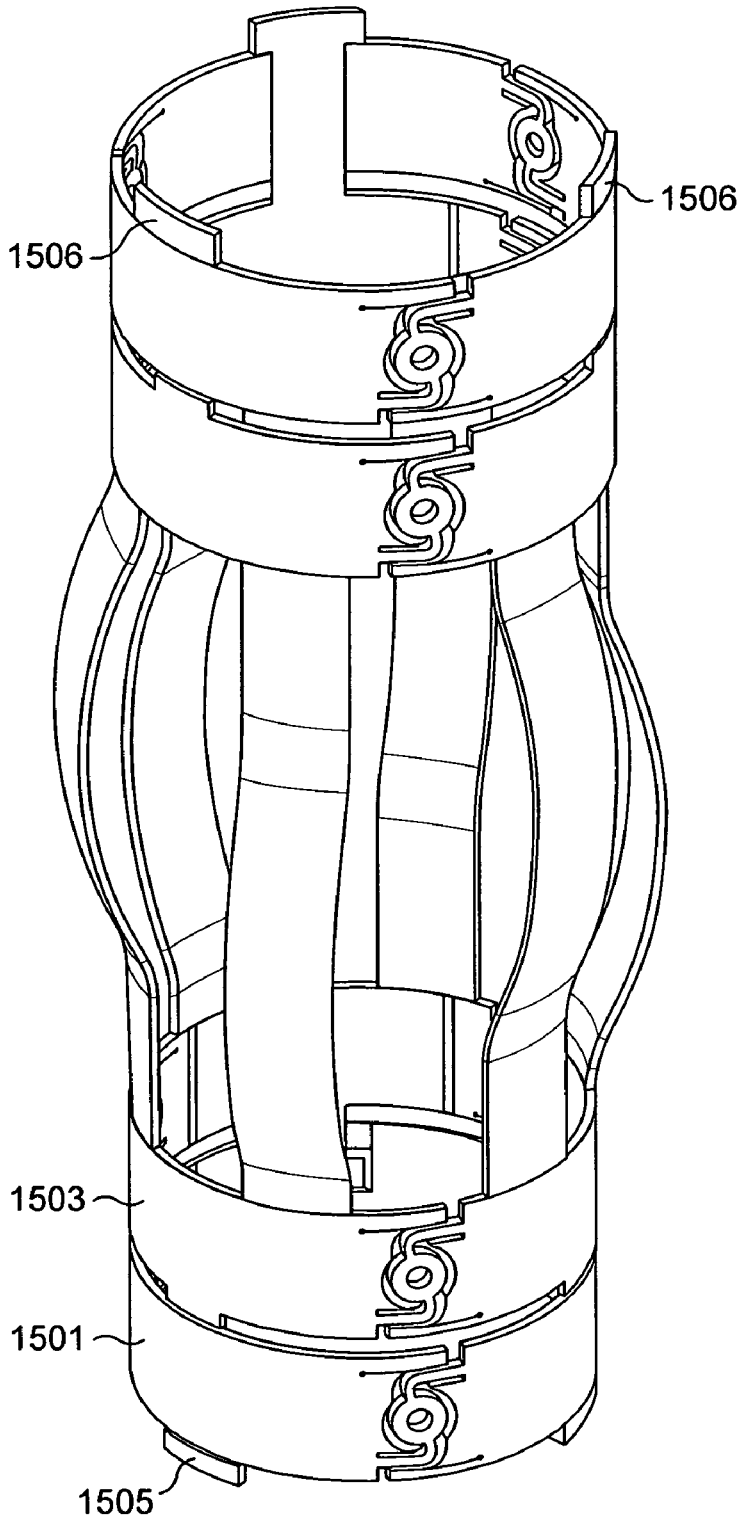

Turning to FIG. 15 this is generally similar to FIG. 11 but in this case the pre-assembled configuration is maintained by projections 1505, 1506 extending from a centralizer 1503 to the outer periphery of the stop collars 1501, 1502.

Figure 16:
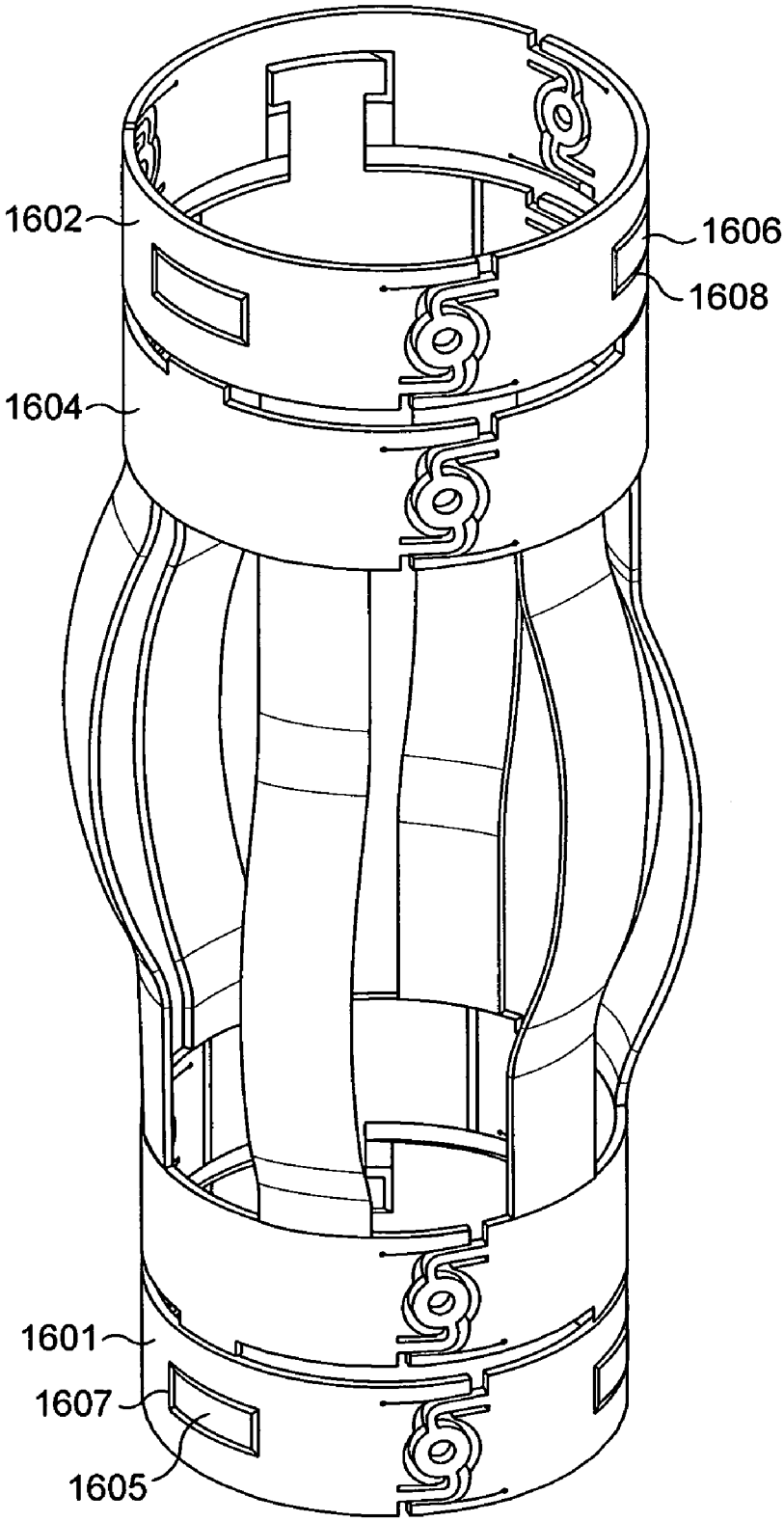

In FIG. 16, projections 1605, 1606 extend from the centralizer 1604 into windows 1607, 1608 in the stop collars 1601, 1602.

Figure 17:
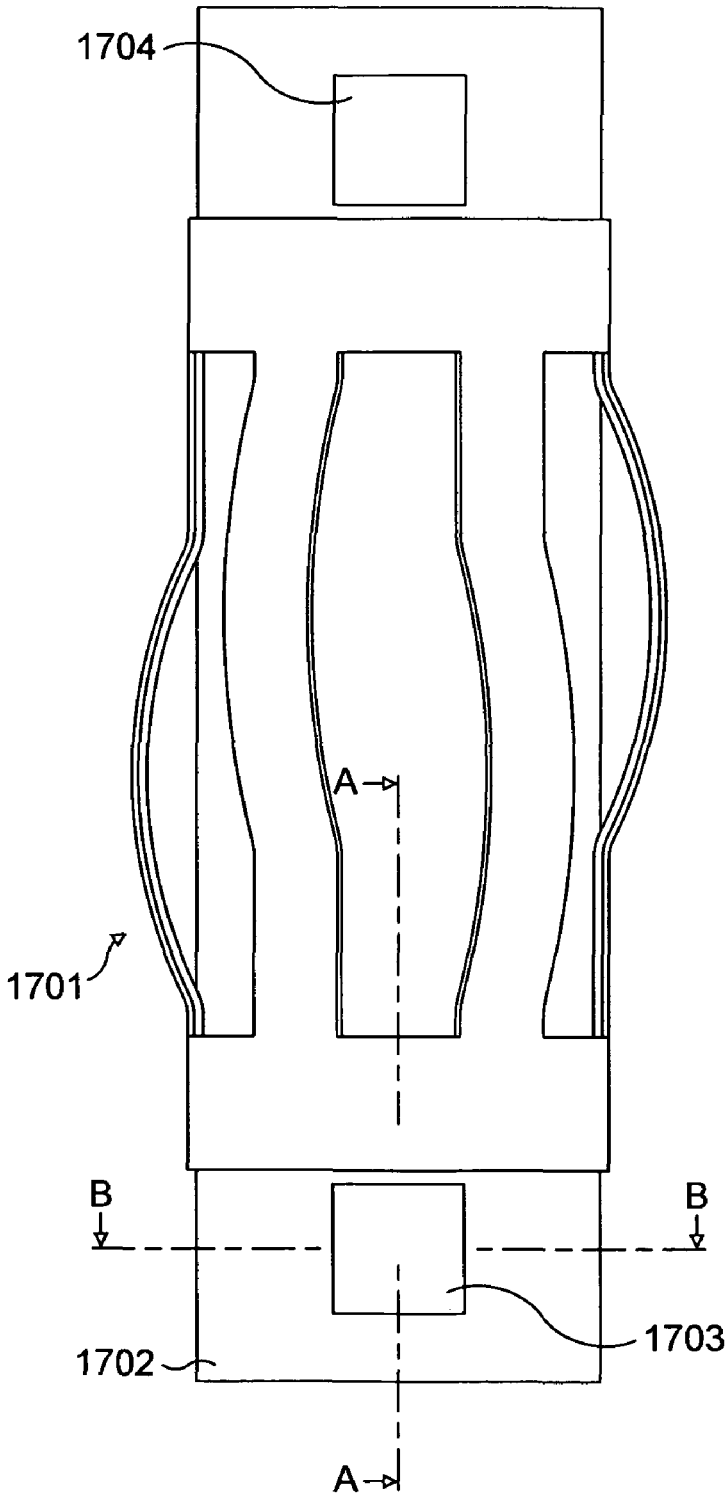

FIG. 17 shows an alternative embodiment in which a centralizer 1701 is freely positioned onto a pipe 1702, in other words is not constrained by stop collars. Pads 1703, 1704 are secured to the pipe 1700 both above and below the centralizer and these allow sufficient clearance to allow for change in the developed length of the centralizer when the bows 1710 are flexed. Pads are existing technology and are commonly cast-on composite materials applied after the centralizer 1701 has been positioned to the desired axial position upon the pipe/tubular 1700. In this situation the pipe may rotate freely with respect to the centralizer which would be prevented from movement itself by contact against a bore hole wall.

Figure 18:
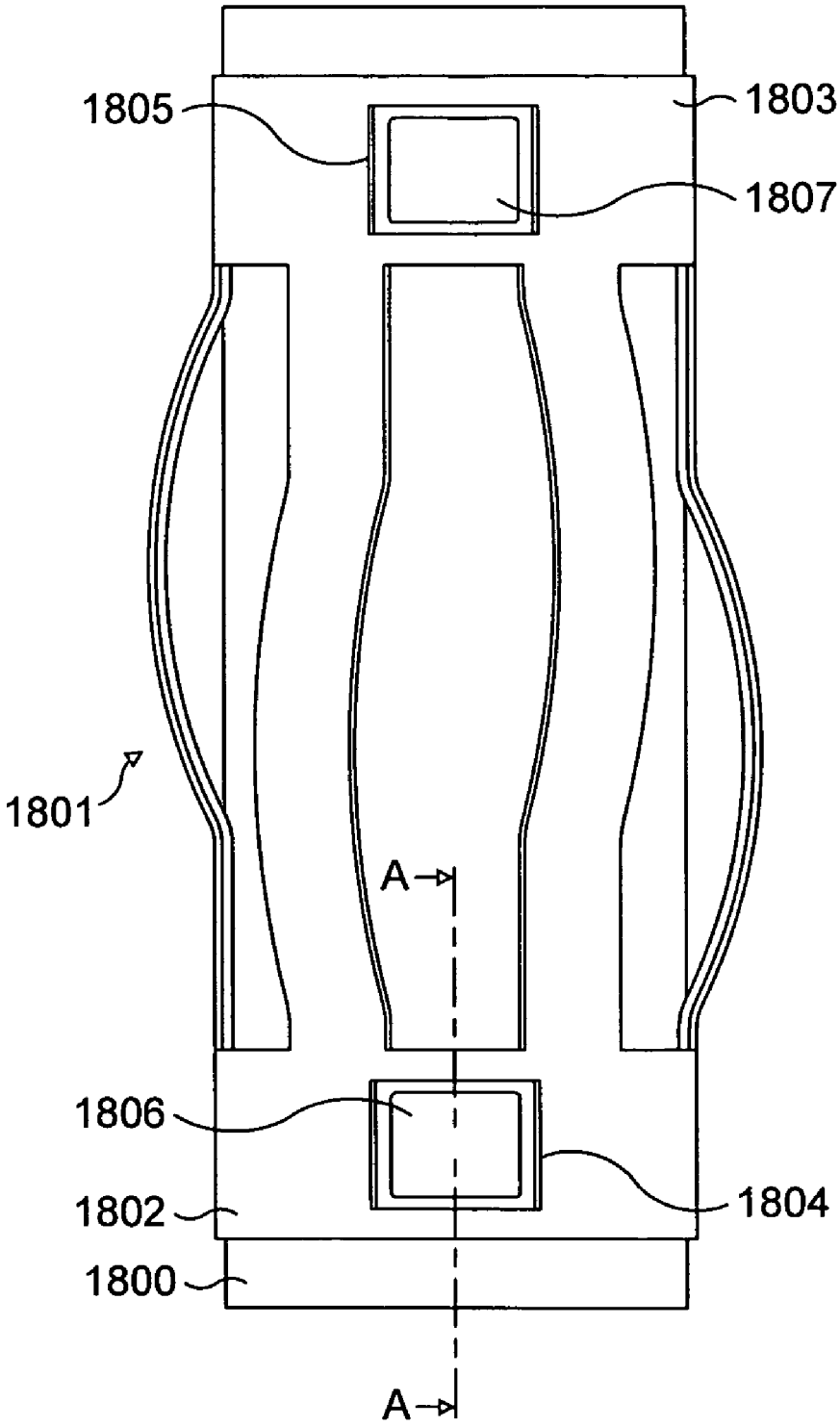

In FIG. 18 an arrangement somewhat similar to that of FIG. 17 is shown. However in this case the pads 1806, 1807 are secured to the pipe 1800 and the pads extend into clearance windows 1804, 1805 in the end bands 1802, 1803 of the centralizer 1801. In this arrangement it is not intended that the pipe should be rotated since it would scour off the pads if it did so or alternatively could jam to the centralizer if the centralizer rode over the pads. In this arrangement it is useful if the pad thickness is similar to or slightly higher than the centralizer to facilitate passage into the borehole where annular clearance between the pipe and the borehole is only slight with the centralizer bows fully compressed on outer diameter.

Figure 19:
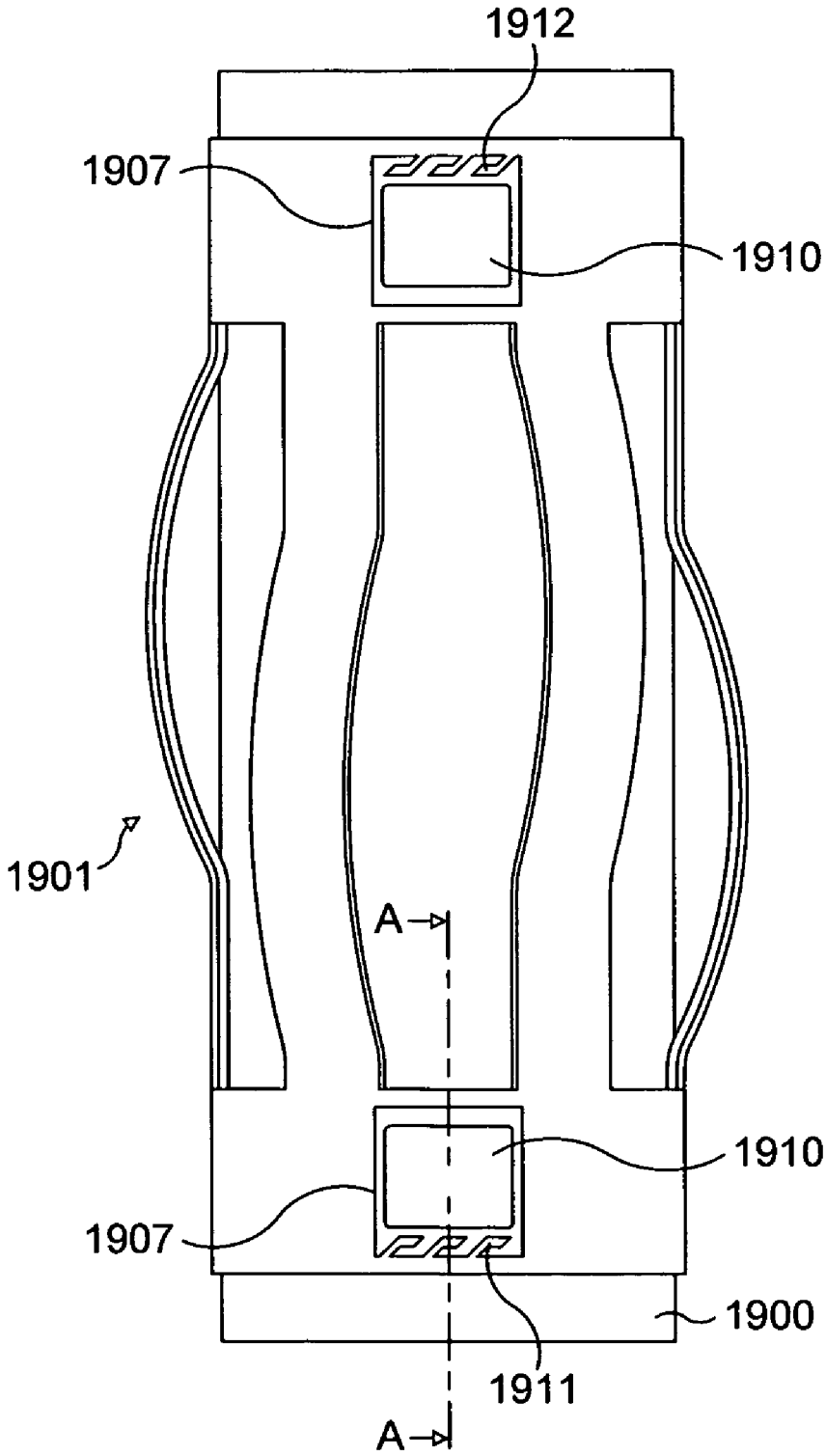

In FIG. 19 a similar arrangement of FIG. 18 is shown. The pads 1909, 1910 are commonly of composite material cast on to the pipe 1900. Positioning is usually a hand operation and misalignment can be present. The material that constitutes the pads is filled with a particulate matter to improve wear. However this increases brittleness with a resultant weakness to point loading on relatively thin pad thicknesses. To overcome this, the spring-treated centralizer 1901 is formed to have small free-end leaf springs 1911, 1912 when the clearance aperture-windows 1906,1907 are formed. This allows for the spreading out and evening of point of contacts.

Figure 20:
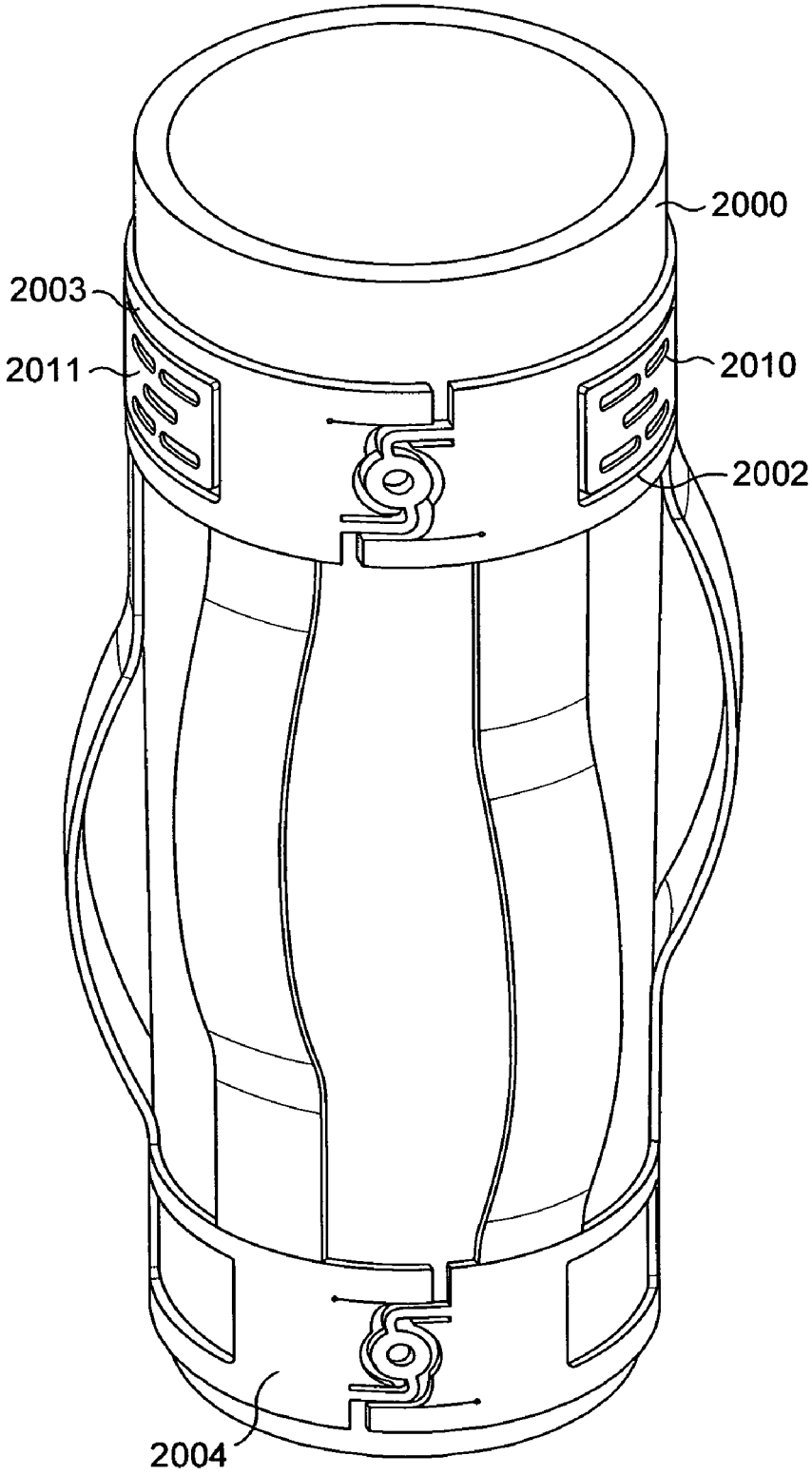

FIG. 20 has pads 2010-2011 encased within a metallic cage that is filled with composite material as it is cast onto the pipe 2000. The cage engages into windows 2002, 2003 of the centralizer 2004. The contact edges under axial load are then metal-to-metal. This avoids the current weakness of point loading of pure composite pads. In such a design it is possible to relieve the underside of the metal cage and create various apertures through the top surface to maximize composite body thickness.

Figure 21:
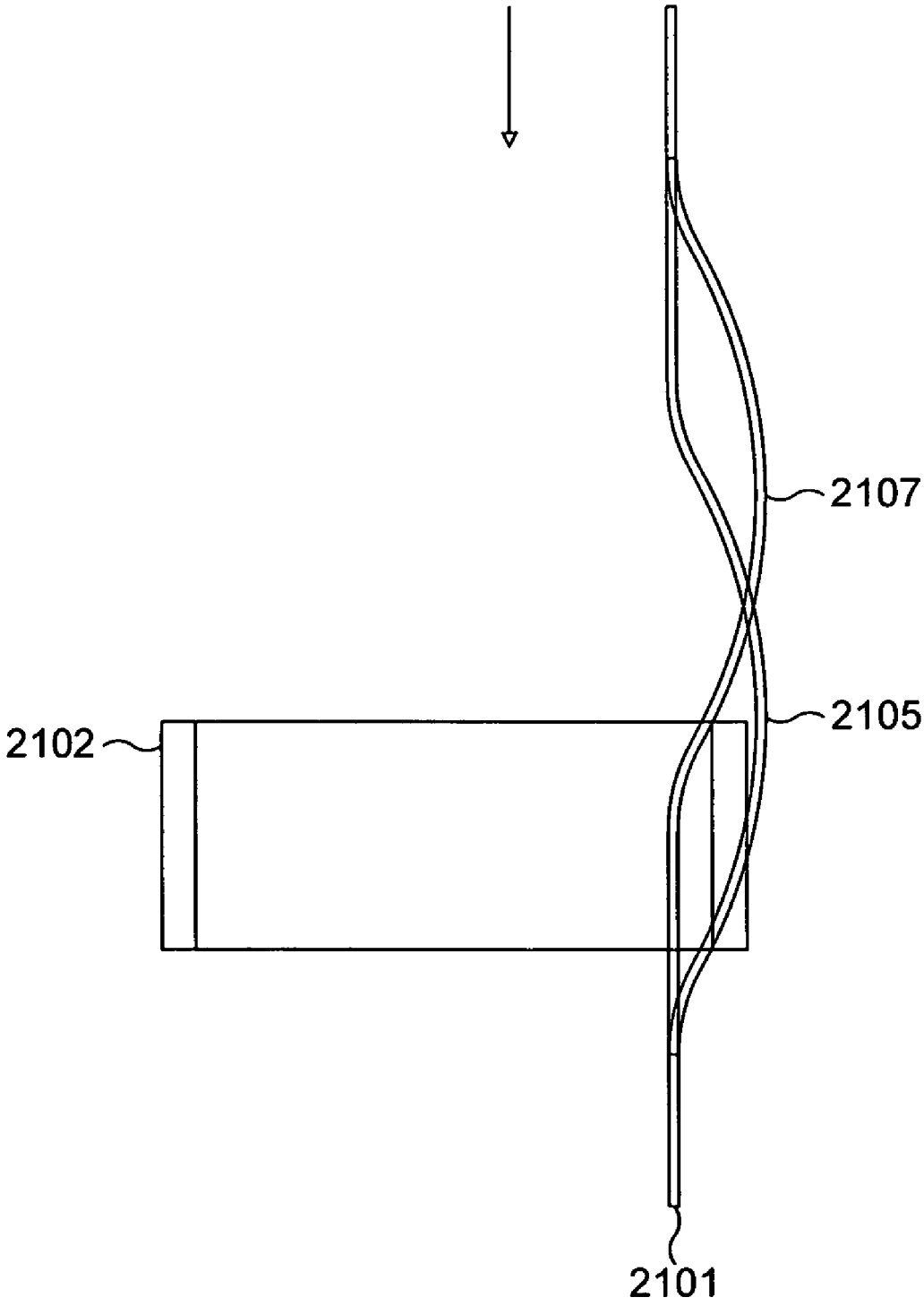
FIG. 21 shows bow an embodiment of an offset bow centraliser has a less savage insertion force requirement than a conventional bow centraliser.

FIG. 21 gives a diagrammatic indication of how the bows of an embodiment of a centraliser 2101 ease the transition of the centraliser into the restriction 2102 of the bore. Of the centraliser 2101, shown in partial section, two offset bows 2105, 2107 can be seen. Other bows are not shown for ease of description.

It can clearly be seen that as the centraliser 2010 moves downwardly in the direction shown by the arrow, the first bow 2105 is compressed into the restriction 2102 before the second bow 2107 starts to become compressed by interaction with the restriction 2102.

This specific embodiment is designed so that one bow is fully compressed before the other starts to compress. How this is achieved will be clear to the skilled person, bearing in mind the relevant diameters and lengths. However the invention is not restricted to this arrangement and a greater offset may be provided or a lesser offset may be provided in different embodiments according to the needs of the application to which the centraliser is put.

By contrast, with no offset, all bows will engage at the same time, and all will need to be compressed during a relatively small insertion distance, creating a more savage insertion force.

While some embodiments of the present invention have been described using specific terms, such description is for the purpose of only illustrating the principle and applications of the present invention, and it is to be understood that modifications or changes and variations in arrangement may be further made without departing from the spirit or scope of the appended claims underlying the technical ideas of the present invention.

What is claimed is:

1. A centralizer having first and second opposing end collars, the end collars being axially separated by plural spring bows, the spring bows forming a generally convex curve, with a first set of bows extending from the first end collar substantially axis-parallel for a first distance before extending via the curve into the second end collar, and a second set of bows extending curvedly from the first end collar and into a substantially axis-parallel portion at the second end collar, whereby the centralizer is formed of a single piece, the first set of bows longitudinally offset from the second set of bows whereby upon insertion into a bore one of the first set of bows and the second set of bows engages the bore before the other set, wherein each bow of the first set is between two bows of the second set and each bow of the second set is between two bows of the first set around the end collars.

2. The centralizer according to claim 1, in which at least one of the end collars comprises a generally cylindrical band having at least one arcuate portion with opposing end regions, the end regions being coupled together by a connecting portion having a pair of arm portions extending on respective sides of a body portion, distal ends of the arm portions extending into the end regions, the body portion having a formation for engagement therein of a tool whereby rotation of the body portion by the tool varies the size of the end collar, the end collar further comprising means for securing the arm portions with respect to an adjacent end region so that the end collar can be locked.

3. The centralizer according to claim 2, in which the at least one end collar has a plurality of arcuate portions each having respective end regions, and a corresponding plurality of connecting portions.

4. The centralizer according to claim 2, in which the connecting portions of the end collar are generally S shaped.

5. The centralizer according to claim 2, in which the or each arcuate portion of the end collar has prolongations to form guides for constraining sideways movement of the arm portions.

6. The centralizer according to claim 5, wherein the guides have teeth to interact with counterpart teeth on the arm portions to form the engagement means.

7. The centralizer according to claim 2, wherein the at least one end collar is substantially circular with an axis, the or each arcuate portion having a first axis-parallel width and the arm portions having a second axis-parallel width that is less than the first width.

8. The centralizer according to claim 2, being formed of micro-alloy steel.

* * * * *